US006004120A

United States Patent [19]

Matsubara et al.

[11] Patent Number: 6,004,120

[45] **Date of Patent: *Dec. 21, 1999**

[54] APPARATUS FOR MANUFACTURING PRESSED POWDER BODY

[75] Inventors: Sadao Matsubara; Noboru Sugiura, both of Kumamoto, Japan

[73] Assignee: Honda Giken Kogyo Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/639,828

[22] Filed: Apr. 29, 1996

[30] Foreign Application Priority Data

| | | | |
|---|---|---|---|
| Nov. 16, 1995 | [JP] | Japan | 7-298006 |
| Nov. 16, 1995 | [JP] | Japan | 7-298018 |
| Jan. 23, 1996 | [JP] | Japan | 8-008868 |

[51] Int. Cl.[6] ..... B22F 3/02

[52] U.S. Cl. ..... 425/78; 425/352; 425/355; 425/356; 425/414; 425/415; 425/418

[58] Field of Search ..... 425/78, 352, 355, 425/356, 414, 415, 418

[56] References Cited

U.S. PATENT DOCUMENTS

| | | | |
|---|---|---|---|
| 4,289,472 | 9/1981 | Dorsey | 425/352 |
| 4,818,201 | 4/1989 | Howard | 425/78 |
| 5,037,287 | 8/1991 | Hirai | 425/352 |
| 5,259,744 | 11/1993 | Take | 425/352 |
| 5,326,242 | 7/1994 | Katagiri et al. | 425/352 |
| 5,366,363 | 11/1994 | Good et al. | 425/352 |
| 5,378,416 | 1/1995 | Kishi et al. | 425/352 |
| 5,698,149 | 12/1997 | Hinzmann | 425/356 |

FOREIGN PATENT DOCUMENTS

| | | |
|---|---|---|
| 0 097 027 | 12/1983 | European Pat. Off. . |
| 0 528 761 | 2/1993 | European Pat. Off. . |
| 74 09071 | 11/1974 | France . |
| 1 583 766 | 9/1970 | Germany . |

OTHER PUBLICATIONS

Patent Abstracts of Japan, vol. 97, No. 7, Jul. 31, 1996 re Japanese Publication 08–067905 dated Mar. 12, 1996.

Patent Abstracts of Japan, vol. 18, No. 98, Feb. 17, 1994 re Japanese Publication 05–302102 dated Nov. 16, 1993.

*Primary Examiner*—James P. Mackey

*Attorney, Agent, or Firm*—Merchant & Gould, P.C.

[57] ABSTRACT

An apparatus for manufacturing a pressed powder body has a die assembly comprising an upper die and a lower die, for pressing an unpressed powder body of a material powder filled on a pressing surface of the lower die, into a pressed powder body between the upper die and the lower die, at least one of the upper die and the lower die being vertically movable to press the unpressed body, and a powder increasing mechanism for increasing an amount of the material powder locally in the unpressed powder body. The powder increasing mechanism comprises at least one of the upper die and the lower die, the at least one of the upper die and the lower die comprising a first die member for pressing a first portion of the unpressed powder body at a first time and a second die member for pressing a second portion of the unpressed powder body at a second time which is different from the first time.

12 Claims, 9 Drawing Sheets

APPARATUS FOR MANUFACTURING PRESSED POWDER BODY

BACKGROUND OF THE INVENTION

1. Field of the Invention

The present invention relates to the art of powder metallurgy, and more particularly to a method of and an apparatus for pressing a fine metal powder into a compacted body having a gear shape or the like which will be sintered into a gear as a powder metallurgy product, in a manner to increase the mechanical strength of a local region of the completed gear.

2. Description of the Related Art

There has heretofore been known a powder metallurgy process for manufacturing sintered mechanical parts such as gears which are required to have a desired degree of wear resistance and rigidity. According to the powder metallurgy process, a fine metal powder is pressed into a compacted body having a gear shape, for example, by a pressing machine, and the compacted body is heated, i.e., sintered, into a gear. The pressing machine comprises a lower die having a cavity for receiving the fine metal powder and an upper punch movable into the cavity to press the fine metal powder into a compacted gear shape.

For producing a gear with a hole defined centrally therein using such a pressing machine, a fine metal powder is filled in the cavity of the die around a core placed at the center of the cavity, and then the core is lifted to a position where the upper surface of the core is higher than the upper surface of the filled fine metal powder. Thereafter, the punch is lowered into the cavity to press the fine metal powder around the core. The compacted body has a hole defined centrally therein by the core which has been removed.

Heretofore, powder metallurgy products that are pressed by a die and a punch have uniform mechanical properties because they are subject to uniform loads over their entire surface regions. Some mechanical parts need to have different mechanical properties in different regions thereof. For example, gears should have greater strength and toughness at their teeth and greater wear resistance at their center. However, it has been impossible for powder metallurgy products to have different local mechanical properties.

FIG. 13 of the accompanying drawings shows a conventional process of manufacturing a pressed powder body as a gear blank. As shown in FIG. 13, when a core 51 is lifted to a position where it is higher than the upper surface of a fine metal powder G placed in a die cavity, the circumferential edge of the upper surface of the core 51 scrapes off and carries upwardly a surrounding layer of the metal powder G, resulting in a reduction in the density of the fine metal powder G around the hole therein. After the fine metal powder G thus shaped is pressed by an upper punch 52 and then sintered into a gear, the formed gear has a reduced mechanical strength around its central hole. As a consequence, if a rotational shaft is pressed into the central hole of the gear, then the region of the gear around the central hole tends to be damaged in use especially if the gear is a helical gear or the like which is likely to develop eccentric stresses in the central region of the gear. If the gear is machined to form internal gear teeth around its central hole, then the internal gear teeth are apt to be broken in use.

There has been a demand in the art for a process of preventing the density of a fine metal powder from being lowered around a hole which is defined in the fine metal powder by the core 51, so that the mechanical strength of the completed gear will not be reduced around the central hole thereof. Stated otherwise, it has been desired in the art of powder metallurgy to process a fine metal powder, at the time of pressing and sintering it into a powder metallurgy product such as a gear, in a manner to give different local mechanical properties to the completed powder metallurgy product.

SUMMARY OF THE INVENTION

It is therefore an object of the present invention to provide a method of and an apparatus for manufacturing a pressed powder body which will be sintered into a powder metallurgy body, in a manner to give different local mechanical properties to the powder metallurgy product.

Another object of the present invention is to provide a method of and an apparatus for manufacturing a pressed powder body by pressing a material powder such that different local densities are developed in the pressed powder body.

According to the present invention, there is provided an apparatus for manufacturing a pressed powder body, comprising a die assembly comprising an upper die and a lower die, for pressing an unpressed powder body of a material powder filled on a pressing surface of the lower die, into a pressed powder body between the upper die and the lower die, at least one of the upper die and the lower die being vertically movable to press the unpressed body, and powder increasing means for increasing an amount of the material powder locally in the unpressed powder body.

The powder increasing means may comprise at least one of the upper die and the lower die, the at least one of the upper die and the lower die comprising a first die member for pressing a first portion of the unpressed powder body at a first time and a second die member for pressing a second portion of the unpressed powder body at a second time which is different from the first time. Specifically, after the first die member starts pressing the first portion of the unpressed powder body, the second die member starts pressing the second portion of the unpressed powder body, whereby the amount of the material powder in the second portion of the unpressed powder body which is pressed by the second die member is greater than before the first die member starts pressing the first portion of the unpressed powder body.

The upper die may comprise an inner punch as the first die member and an outer punch as the second die member which is rotatable around the inner punch and movable axially with respect to the inner punch. The apparatus may further comprise lowering means for exerting a lowering force to the upper die to move toward the lower die, the outer punch being rotatably mounted on the lowering means, and pressing means interposed between the lowering means and the upper die, for applying a pressing force to the inner punch to project a pressing lower end surface of the inner punch downwardly beyond a pressing lower end surface of the outer punch, and allowing the pressing lower end surface of the inner punch to lie flush with the pressing lower end surface of the outer punch under the lowering force exerted to the upper die by the lowering means at least in a final stage of pressing the unpressed powder body into the pressed powder body.

If the apparatus is arranged to manufacture a pressed powder body as a gear blank having helical teeth on an outer circumferential surface thereof, then the upper die may include a first rotatable member, and the lower die may include a second rotatable member, the first rotatable member and the second rotatable member being rotatable with respect to each other, at least the first rotatable member having helical teeth on an outer circumferential surface thereof, the second rotatable member having helical teeth on an inner circumferential surface thereof for meshing engagement with the helical teeth on the outer circumferential surface of the first rotatable member, and the apparatus also has a phasing mechanism comprising a support member movable with the first rotatable member toward the second rotatable member and stoppable at a position after having moved with the first rotatable member toward the second rotatable member, a guide member fastened to the support member and held in mesh with the helical teeth on the outer circumferential surface of the first rotatable member, for guiding the first rotatable member for rotation, and means for angularly adjusting the guide member with respect to the support member to phase the first rotatable member to the second rotatable member and preventing the guide member which has been angularly adjusted from being angularly displaced. When the first and second rotatable bodies operate repeatedly, they are allowed to mesh smoothly with each other without undue angular displacement to efficiently produce helical teeth on the gear blank.

The lower die may comprise a die which defines thereabove a die cavity for filling the material powder therein, and the powder increasing means may comprise a core disposed vertically movably in the die cavity for defining a vertical hole in the pressed powder body, the material powder being filled in the die cavity with the core disposed in the die cavity, the upper die comprising a punch for pressing the unpressed powder body, except the core, in the die cavity to produce the pressed powder body with the vertical hole defined therein, the core having an upper end including a slanted peripheral surface inclined at a predetermined angle downwardly in an outward direction.

The core may be movable through the lower die into the die cavity, and after the material powder is filled in the die cavity and before the unpressed powder body is pressed by the upper die and the lower die, the core may be moved vertically through the unpressed powder body to allow a portion of the material powder deposited on the slanted peripheral surface to drop down the slanted peripheral surface off the upper end of the core for thereby increasing the amount of the material powder around the core. The pressed powder body has a higher density of the material powder in a local region around the vertical hole defined centrally in the pressed powder body by the core.

A method of manufacturing a pressed powder body according to the present invention may be carried out by the above apparatus. Specifically, the method of manufacturing a pressed powder body by pressing an unpressed powder body of a material powder between an upper die and a lower die, comprises the step of pressing the unpressed powder body locally at a different time to cause the unpressed powder body to locally contain a different amount of the material powder from before the unpressed powder body is pressed.

Specifically, the peripheral portion starts being pressed after a portion of the material powder is pushed into the peripheral portion by pressing the inner portion of the unpressed powder body. In the pressed powder body, the density of the material powder is higher in the peripheral portion than in the inner portion.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENT

Figure 1:
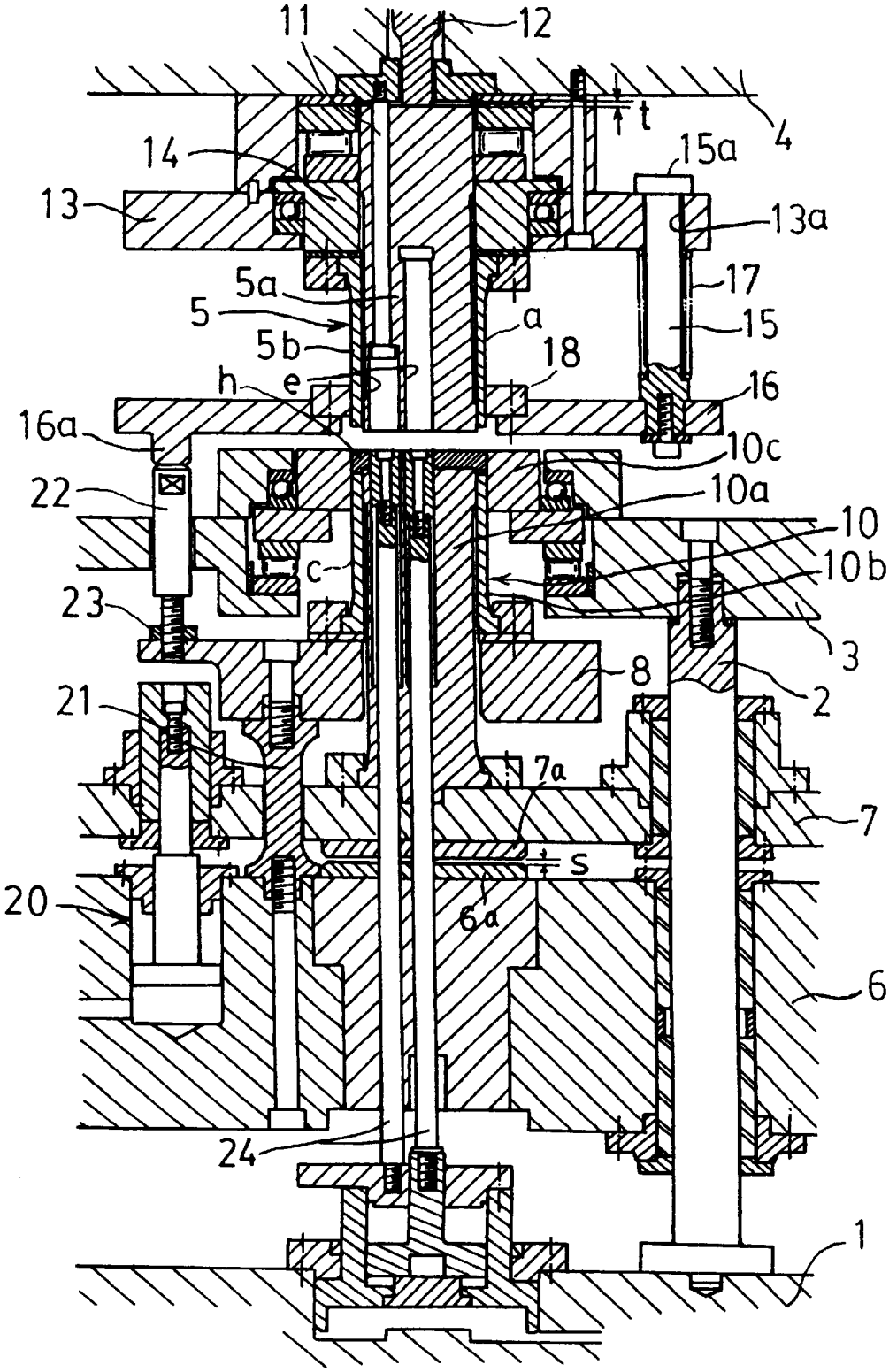
FIG. 1 is a fragmentary vertical cross-sectional view of an apparatus for manufacturing a pressed powder body according to a first embodiment of the present invention, the view showing the position of the parts before a material powder is pressed.

FIG. 1 shows an apparatus for manufacturing a pressed powder body according to a first embodiment of the present invention. The apparatus according to the first embodiment is used to manufacture a pressed powder body in the shape of a helical gear from a fine metal powder, and includes a means for increasing the mechanical strength of its outer circumferential gear teeth.

As shown in FIG. 1, the apparatus according to the first embodiment has an under plate 1, a lower plate 3 fixedly mounted on the under plate 1 by a vertical joint rod 2, and an upper plate 4 movable vertically toward and away from the lower plate 3, the upper plate 4 supporting an upper punch 5. The punch 5 comprises a cylindrical inner punch 5*a* and an tubular outer punch 5*b* disposed around the inner punch 5*a*.

Between the under plate 1 and the lower plate 3, there are disposed a fixed base 6, a floating plate 7 positioned above the fixed plate 6, and an outer die holder 8 positioned above the floating plate 7. A lower die 10 is fixedly mounted on the floating plate 7, the outer die holder 8, and the lower plate 3. Specifically, the die 10 comprises a cylindrical inner die 10*a*, a tubular outer die 10*b* disposed around the inner die 10*a*, and an annular internal tooth die 10*c* disposed around the outer die 10*b*. The inner die 10*a* is fixed to an upper surface of the floating plate 7. The outer die 10*b* is fixed to an upper surface of the outer die holder 8. The internal tooth die 10*c* is mounted on the lower plate 3. The inner punch 5*a* and the inner die 10*a* have substantially the same diameter as each other, and the outer punch 5*b* and the outer die 10*b* have respective lower and upper end portions which have substantially the same diameter and wall thickness as each other.

The internal tooth die 10*c* has an upper end surface lying higher than upper end surfaces (pressing surfaces) of the inner die 10*a* and the outer die 10*b*, and circumferentially surrounds a space defined as a die cavity above the upper end surfaces of the inner die 10*a* and the outer die 10*b*. A material powder "h" such as a fine metal powder is filled in the die cavity, and vertically pressed into a pressed powder body "h1" (see FIG. 2) having a desired shape by the punch 5 which is lowered into the die cavity.

The punch 5 will be described in detail below.

Figure 3:
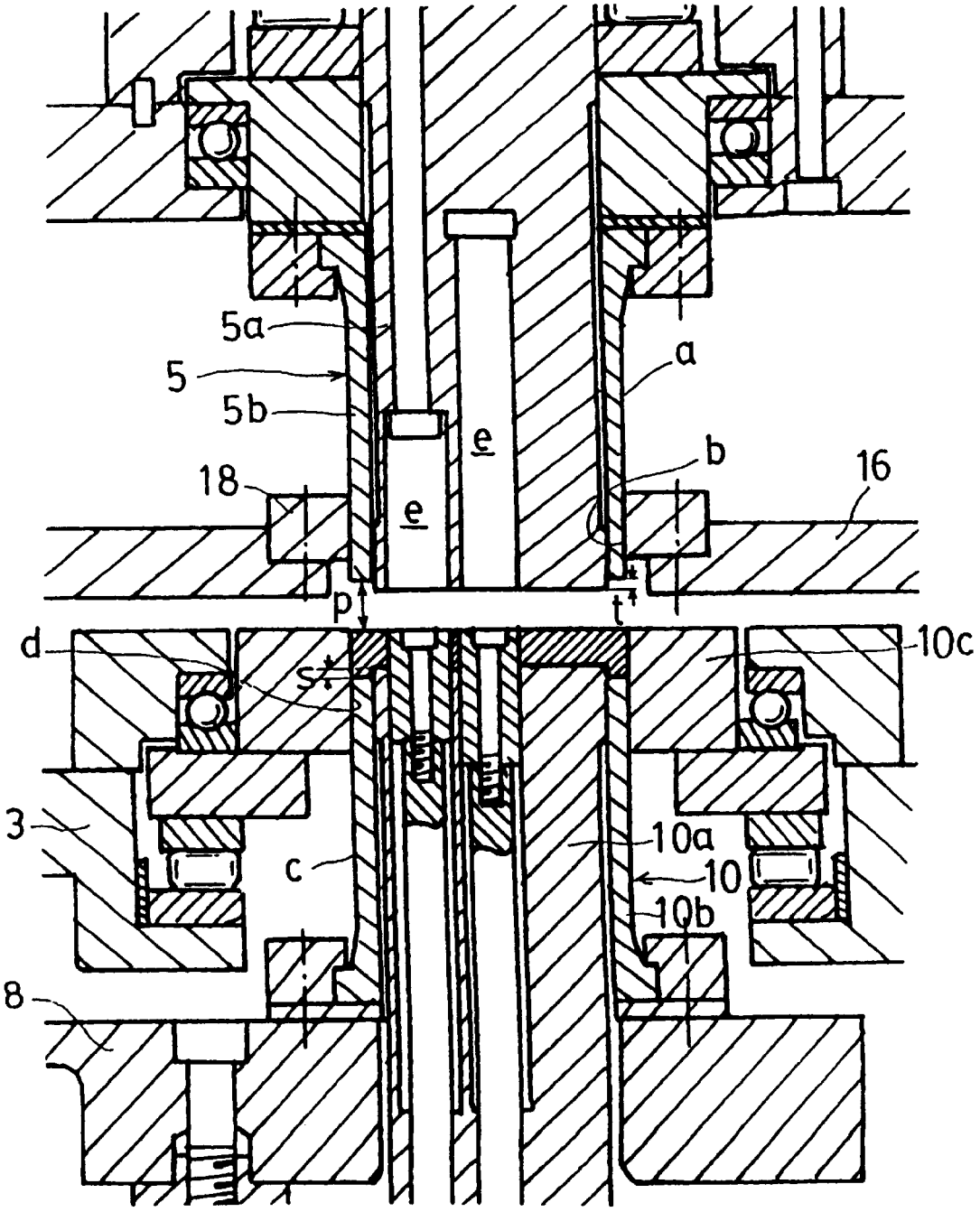
FIG. 3 is an enlarged fragmentary cross-sectional view of the apparatus shown in FIG. 1.

The inner punch 5*a* is coupled to the upper plate 4 by a vertical joint rod 11 and has an upper end surface pressed downwardly by an ejector rod 12 that is vertically disposed in the upper plate 4. The upper end surface of the inner punch 5*a* which is pressed downwardly by an ejector rod 12 is spaced downwardly from a lower surface of the upper plate 4 by a gap or distance "t" therebetween. The inner punch 5*a* has a lower end surface projecting downwardly beyond a lower end surface of the outer punch 5*b* by the same distance "t" (see FIG. 3).

An upper guide plate 13 is affixed to the lower surface of the upper plate 4 in surrounding relation to the inner punch 5*a*. The upper guide plate 13 supports an outer punch holder 14 disposed centrally therein and rotatably mounted thereon by a bearing for rotation around the inner punch 5*a*. The outer punch 5*b* is secured to a lower end of the outer punch holder 14. The outer punch 5*b* has helical teeth "a" on an outer circumferential surface of a lower end portion thereof.

The upper guide plate 13 has a vertical through hole 13*a* defined therein remotely from the outer punch holder 14, and a vertical slide rod 15 is vertically slidably inserted through the vertical through hole 13*a*. The vertical slide rod 15 has a flange 15*a* on its upper end which is normally held against an upper surface of the upper guide plate 13. The vertical slide rod 15 has a lower end fixed to an upper support plate 16 which is spaced downwardly from the upper guide plate 13. A spring 17 is disposed around the vertical slide rod 15 for normally biasing the upper guide plate 13 and the upper support plate 16 away from each other when they are displaced toward each other.

An annular internal tooth guide 18 is supported centrally on the upper support plate 16 and held in mesh with the helical teeth "a" on the outer circumferential surface of the outer punch 5*b* which extends vertically through the annular internal tooth guide 18. Specifically, the annular internal tooth guide 18 has helical teeth "b" (see FIG. 3) on its inner circumferential surface which are held in mesh with the helical teeth "a" on the outer circumferential surface of the outer punch 5*b*.

The upper support plate 16 has a boss 16*a* projecting downwardly at a position remote from the vertical slide rod 15, for abutment against a stop 22 (described later on).

The lower plate 3 is fixedly mounted on the under plate 1 by the joint rod 2, as described above. The floating plate 7 is floatingly supported on the fixed base 6 by a floating mechanism 20, and is vertically movable along the joint rod 2. The fixed base 6 supports an abutment pad 6*a* on its upper surface, and the floating plate 7 supports an abutment pad 7*a* on its lower surface. The abutment pad 6*a* and the abutment pad 7*a* are vertically aligned with each other, and normally spaced from each other by a gap or distance "s" (see FIG. 1). With the abutment pad 6*a* and the abutment pad 7*a* spaced from each other by the distance "s", the upper end surface of the inner die 10*a* is spaced upwardly from the upper end surface of the outer die 10*b* by the same distance "s" (see FIG. 3).

The outer die holder 8 is fixedly mounted on the fixed base 6 by a vertical joint rod 21.

The inner die 10*a* which is fixed to the upper surface of the floating plate 7 extends upwardly through the outer die holder 8. The outer die 10*b* which is fixed to the upper surface of the outer die holder 8 extends upwardly in surrounding relation to the inner die 10*a*. The outer die 10*b* has helical teeth "c" on an outer circumferential surface thereof.

The internal tooth die 10*c* is rotatably mounted centrally on the lower plate 3 by bearings. The internal tooth die 10*c* has helical teeth "d" (see FIG. 3) on its inner circumferential surface which are held in mesh with the helical teeth "c" of the outer die 10*b*.

The stop 22 is mounted on the outer die holder 8 and projects upwardly through the lower plate 3 underneath the boss 16*a* of the upper support plate 16. The stop 22 can be adjusted in height by an adjuster 23. The height of the stop 22 is adjusted by the adjuster 23 to adjust the time at which the boss 16*a* and the stop 22 abut against each other.

The time of abutment between the boss 16*a* and the stop 22 is adjusted to phase the lower peripheral edge of the helical teeth "a" of the outer punch 5*b* to the upper peripheral edge of the helical teeth "d" of the internal tooth die 10*c*. Because the outer punch 5*b* which is lowered starts rotating when the boss 16*a* abuts against the stop 22, the clearance "p" (see FIG. 3) between the lower end of the outer punch 5*b* (the lower peripheral edge of the helical teeth "a") and the upper end of the internal tooth die 10*c* (the upper peripheral edge of the helical teeth "d") is adjusted through adjustment of the time of abutment between the boss 16*a* and the stop 22 for thereby phasing the outer punch 5*b* and the internal tooth die 10*c* to each other for proper mesh with each other.

Specifically, the helical teeth "a" of the outer punch 5*b* are not angularly displaced until the boss 16*a* abuts against the stop 22. Following the abutment of the boss 16*a* against the stop 22, the angular displacement of the outer punch 5*b* before it starts meshing with the internal tooth die 10*c* is determined solely by the clearance "p". The clearance "p" can be adjusted by adjusting the height of the stop 22 with the adjuster 23 for allowing the outer punch 5*b* and the internal tooth die 10*c* to start smoothly meshing with each other.

A pressed powder body in the shape of a helical gear which is manufactured by the apparatus according to the first embodiment has a plurality of axial through holes defined in central and surrounding positions. To form those axial through holes, a plurality of vertical rods 24 are fixedly mounted on the under plate 1 and extend through the inner die 10*a*. The vertical rods 24 have respective upper ends positioned substantially flush with the upper surface of the internal tooth die 10*c*.

The inner punch 5*a* has a plurality of clearance holes "e" defined vertically therein and opening downwardly at the lower end of the inner punch 5*a* for receiving the respective upper ends of the vertical rods 24 when the inner punch 5*a* is lowered toward the inner die 10*a*, so that the upper ends of the vertical rods 24 will not interfere with the lower surface of the inner punch 5*a*. The joint rod 11 is inserted vertically through the inner punch 5*a* and one of the clearance holes "e".

The apparatus according to the first embodiment operates to form a pressed powder body in the shape of a helical gear as follows:

The upper plate 4 is elevated from the position shown in FIG. 1, and then a material powder "h" such as a fine metal powder (unpressed powder body) is filled in the space or die cavity in the internal tooth die 10*c*. At this time, as shown in FIG. 1, the upper end of the inner die 10*a* is higher than the upper end of the outer die 10*b*, and hence their pressing surfaces are in vertically different positions.

After the fine metal powder is filled in the die cavity, the upper plate 4 is lowered. Initially, the outer punch 5*b* descends, without rotating, together with the inner punch 5*a*, the upper guide plate 13, and the upper support plate 16. When the boss 16*a* of the upper support plate 16 abuts against the stop 22, the upper support plate 16 stops descending, and the upper guide plate 13 keeps descending while compressing the spring 17. The outer punch 5*b* which is held in mesh with the internal tooth guide 18 then starts to rotate around the inner punch 5*a*, which also keeps descending with the outer punch 5*b*. The clearance "p" between the lower end of the outer punch 5*b* and the upper end of the internal gear die 10*c* upon abutment between the boss 16*a* and the stop 22 has been adjusted in advance to phase the outer punch 5*b* and the internal tooth die 10*c* to each other for starting smooth meshing engagement with each other.

Figure 2:
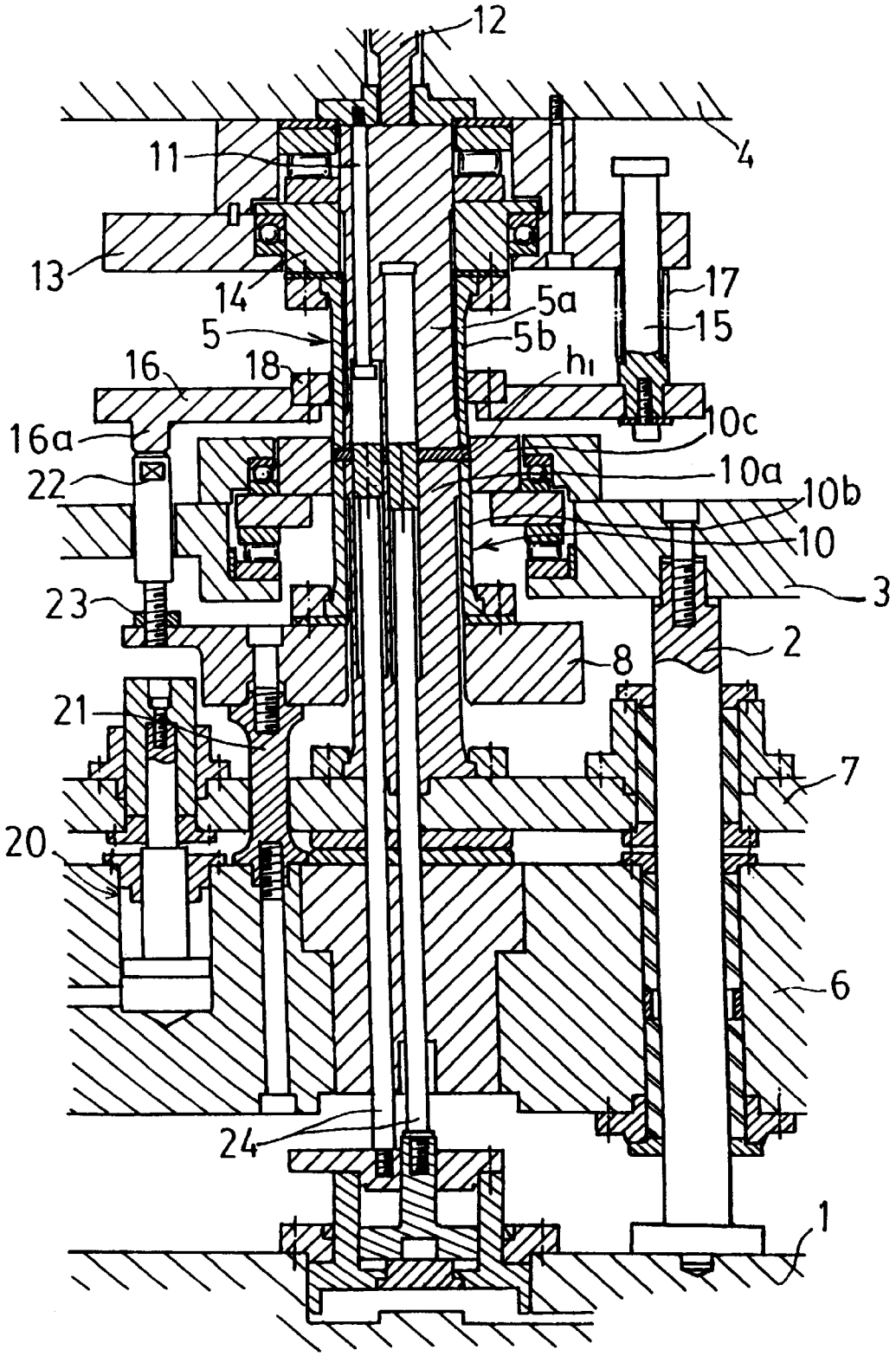
FIG. 2 is a fragmentary vertical cross-sectional view of the apparatus, showing the position of the parts after the material powder is pressed.
Figure 4:
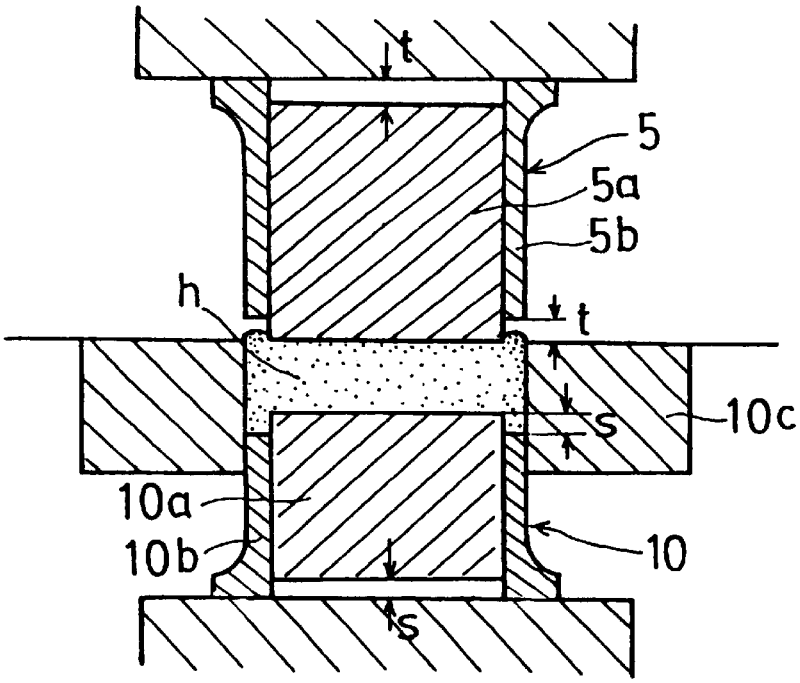
FIG. 4(A) is a fragmentary vertical cross-sectional view of central parts of the apparatus shown in FIG. 1, illustrating a process stage in which an inner punch has started to press the material powder.
FIG. 4(B) is a fragmentary vertical cross-sectional view of central parts of the apparatus shown in FIG. 1, illustrating a final pressing process stage in which an outer punch has started to press the material powder after the process stage shown in FIG. 4(A)
Figure 4:
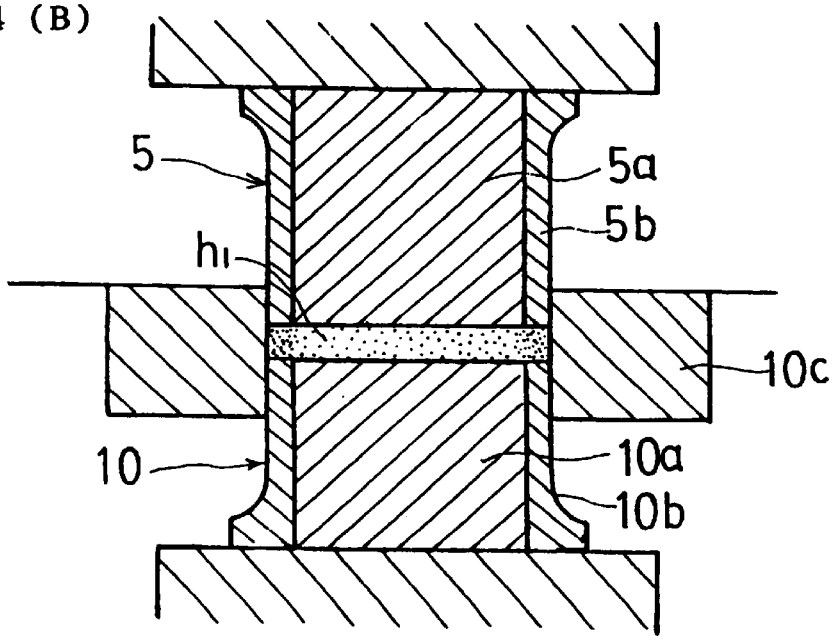

As shown in FIG. 4(A), the inner punch 5*a* is lowered to start pressing the material powder "h". A central portion of the material powder "h" positioned directly beneath the inner punch 5*a*, i.e., a radially inner portion of the unpressed body, is pushed radially outwardly into a peripheral portion of the material powder "h" directly beneath the outer punch 5*b*, i.e., a radially outer portion of the unpressed body, under the pressure of the inner punch 5*a*. After the inner punch 5*a* and the inner die 10*a* have started to press therebetween the central portion of the material powder "h", the outer punch 5*b* and the outer die 10*b* start to press therebetween the peripheral portion of the material powder "h" which contains more of the material powder "h" than before the inner punch 5*a* starts pressing the material powder "h". The upper plate 4 exerts greater downward forces than the pressing forces applied by the ejector rod 12 and the floating forces applied by the floating mechanism 20. Therefore, the ejector rod 12 and the floating mechanism 20 eventually yield under the downward forces exerted by the upper plate 4, whereupon the outer punch 5*b* is lowered the distance "t" with respect to the inner punch 5*a* until their lower end surfaces level or lie flush with each other, and the inner die 10*a* is lowered the distance "s" with respect to the outer die 10*b* until their upper end surfaces lie flush with each other. As shown in FIGS. 2 and 4(B), the gap "t" between the upper plate 4 and the inner punch 5*a* is eliminated, and the gap "s" between the abutment pads 6*a*, 7*a* is eliminated.

The material powder or unpressed body "h" is pressed into a pressed powder body "h1" in the shape of a helical gear by the inner punch 5*a*, the outer punch 5*b*, the inner die 10*a*, the outer die 10*b*, and the internal tooth die 10*c*. The pressed powder body "h1" thus formed has a higher density in its outer peripheral edge region. When the pressed powder body "h1" is sintered into a helical gear as a powder metallurgy product, the helical teeth thereof have an increased mechanical strength. The method carried out by the above apparatus according to the first embodiment may be applied to produce a pressed powder body in the form of a gear having internal teeth, and may also be applied to produce mechanical parts other than gears.

In the first embodiment described above, each of the punch 5 and the die 10 comprises a plurality of separate members. However, only one of the punch 5 and the die 10 may comprise a plurality of separate members, and the separate members may be actuated to press a material power at different times.

The pressed powder body "h1" may be removed from the apparatus by lowering the under plate 1 with a ram mechanism (not shown), thus causing the joint rod 2 to move the lower plate 3 and the internal tooth die 10*c* downwardly.

If the final powder metallurgy product is a gear having external or internal teeth, then the mechanical strength of those teeth may be increased by increasing the powder density of the peripheral edge region or the inner region of the pressed powder body.

According to the above apparatus for manufacturing a pressed powder body and the method carried out thereby, since the inner and peripheral edge regions of the unpressed body of the material powder are pressed at different times, the inner and peripheral edge regions of the pressed powder body have differently adjusted powder densities, so that a final powder metallurgy product obtained by sintering the pressed powder body will have different local mechanical properties. Specifically, because the inner and peripheral edge regions of the unpressed body are pressed at different times, some of the material power in the inner region of the unpressed body is pushed radially outwardly into the peripheral edge region, thereby producing a localized increase in the amount of the material powder in the peripheral edge region before the unpressed body is pressed in its entirety by the upper punch 5 and the lower die 10. In order to intensify the localized increase in the amount of the material powder in the peripheral edge region, at least one of the upper punch 5 and the lower die 10, e.g., the upper punch 5, comprises inner and outer members, and the inner member projects beyond the outer member toward the material powder filled in the die cavity under a predetermined pressing force, so that the inner and outer members have respective pressing surfaces lying at different heights, respectively, and the upper punch 5 is lowered toward the lower die 10 under a pressure greater than the predetermined pressing force. At least at a final stage of the process of pressing the material powder with the upper punch 5 and the lower die 10, the greater pressure overcomes the predetermined pressing force, causing the pressing surfaces of the inner and outer members to lie flush with each other rather than at the different heights. Consequently, the pressed powder body which is completed has a greater density in its peripheral edge region than in its inner region.

According to the first embodiment, the material powder "h" is filled in the die cavity in the die 10, and then pressed into a pressed powder body in the shape of a helical gear by the punch 5. For forming helical teeth on the outer circumferential surface of the pressed powder body, the internal tooth die 10*c* of the die 10 has the helical teeth "d" on its inner circumferential surface, and the outer punch 5*b* of the punch 5 has the helical teeth "a" on its outer circumferential surface (see FIG. 3). With these helical teeth "d", "a" meshing with each other, the punch 5 and the die 10 are displaced toward each other while rotating relatively to each other for thereby pressing the material powder "h". In order to bring the helical teeth "d", "a" into smooth mesh with each other, it is necessary to phase the punch 5 and the die 10 to each other in their relative rotation at the time the helical teeth "d", "a" begin to mesh with each other.

According to the first embodiment in which the punch 5 is lowered into the die cavity in the die 10, the annular internal tooth guide 18 which is supported centrally on the upper support plate 16 and has the helical teeth "b" on its inner circumferential surface which are held in mesh with the helical teeth "a" on the outer circumferential surface of the outer punch 5*b*, for thereby guiding the punch 5 for rotation and axial movement. Specifically, the helical teeth "a" of the outer punch 5*b* are not angularly displaced until the boss 16*a* abuts against the stop 22. After the boss 16*a* abuts against the stop 22, the angular displacement of the outer punch 5*b* before it starts meshing with the internal tooth die 10*c* is determined solely by the clearance "p". The clearance "p" can be adjusted by adjusting the height of the stop 22 with the adjuster 23 for allowing the outer punch 5*b* and the internal tooth die 10*c* to start smoothly meshing with each other.

Alternatively, the punch 5 may be rotated about its own axis when the annular internal tooth guide 18 is adjusted in phase, i.e., angularly displaced. Therefore, the internal tooth guide 18 may be angularly displaced to phase the punch 5 and the die 10 to each other for starting smooth mesh with each other. For this alternative angular adjustment of the internal tooth guide 18, it is customary for the internal tooth guide 18 to have loose adjustment holes through which the internal tooth guide 18 is temporarily fastened to the upper support plate 16 for angular adjustment, and to fix the internal tooth guide 18 securely to the upper support plate 16 with screws in the loose adjustment holes when the angular adjustment of the internal tooth guide 18 is completed. However, even if the internal tooth guide 18 is securely fastened to the upper support plate 16 with the screws in the loose adjustment holes, the screws often tend to work loose subsequently, allowing the internal tooth guide 18 to be angularly shifted out of proper angular position with respect to the upper support plate 16. Accordingly, the internal tooth guide 18 has to be angularly adjusted again each time it is loosened out of place.

Figure 5:
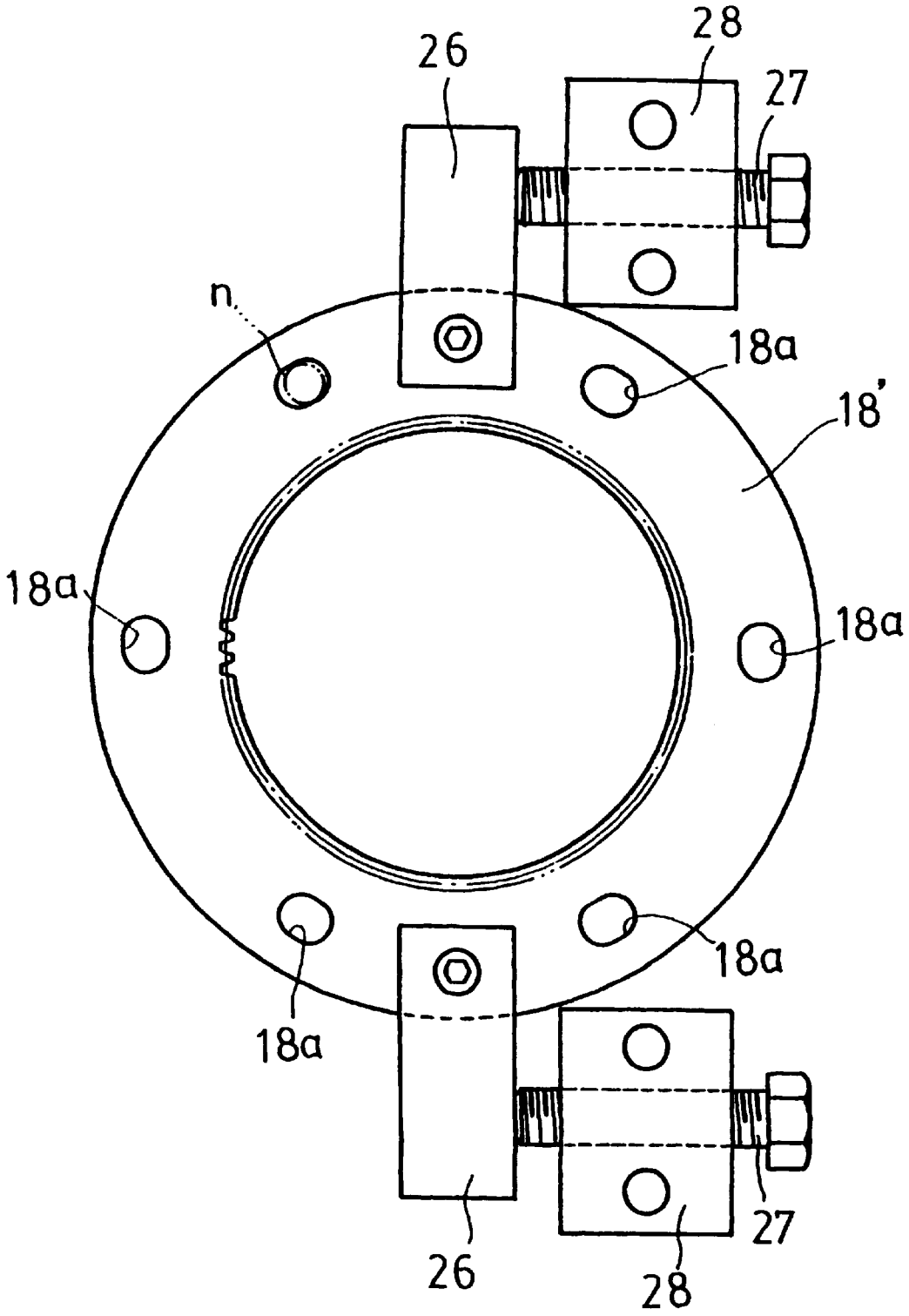
FIG. 5 is a plan view of a mechanism for angularly adjusting an internal tooth guide and preventing the internal tooth guide from being angularly shifted out of position after it has been angularly adjusted, according to a modification of the apparatus shown in FIG. 1.

FIG. 5 shows a modification of the apparatus shown in FIG. 1 which has a mechanism for angularly adjusting an internal tooth guide and preventing the internal tooth guide from being angularly shifted out of position after it has been angularly adjusted.

As shown in FIG. 5, an annular internal tooth guide 18' is angularly adjustably mounted on the upper support plate 16. The internal tooth guide 18' has a plurality of loose adjustment holes 18*a* defined at spaced intervals therein along an outer circumferential edge thereof. The loose adjustment holes 18*a* are elongate in the circumferential direction of the internal tooth guide 18'. The internal tooth guide 18' is fastened to the upper support plate 16 by screws "n" inserted through the respective loose adjustment holes 18*a* and threaded into the upper support plate 16. A pair of diametrically opposite securing bars 26 projecting radially outwardly is fixed to an upper surface of the internal tooth guide 18'. The securing bars 26 are engaged by respective bolts 27.

The bolts 27 are threaded through respective bolt holders 28 that are fixedly mounted on the upper support plate 16. The bolts 27 have respective tip ends held in abutment against side surfaces of the securing bars 26 which face in the same direction. After the screws "n" are loosened, one of the bolts 27 is retracted and the other bolt 27 is projected to angularly displace the internal tooth guide 18' about its own axis. When the internal tooth guide 18' is angularly adjusted correctly, the screws "n" are tightened to firmly fasten the internal tooth guide 18' to the upper support plate 16, and then both the bolts 27 are turned to hold their tip ends against the securing bars 26. The internal tooth guide 18' thus fixed in position is reliably prevented from being accidentally angularly shifted in either direction with respect to the upper support plate 16.

The outer punch 5*b* and the internal tooth die 10*c* are preferably phased to start smooth mesh with each other by first adjusting the clearance "p". As described above, the clearance "p" between the outer punch 5*b* and the internal tooth die 10*c* can be adjusted by adjusting the height of the stop 22 with the adjuster 23 for allowing the outer punch 5*b* and the internal tooth die 10*c* to start smoothly meshing with each other. After the outer punch 5*b* and the internal tooth die 10*c* are roughly phased to each other in the manner described above, the screws "n" are loosened, and the bolts 27 are turned to angularly adjust the internal tooth guide 18' for precisely phasing the outer punch 5*b* and the internal tooth die 10*c* to each other for fine angular adjustment. When the fine angular adjustment is completed, the internal tooth guide 18' is firmly fastened to the upper support plate 16 by the screws "n" and held in position by the bolts 27.

The internal tooth guide 18' thus fixed in position is reliably prevented by the bolts 27 from being accidentally angularly shifted with respect to the upper support plate 16 even when the internal tooth guide 18' is subject to repeated large loads.

The apparatus according to the first embodiment may be modified into a structure in which the upper plate 4 is fixed and the lower plate 3 is movable upwardly toward the upper plate 4 for pressing the material powder "h" in the die cavity. In such a modified structure, the mechanism shown in FIG. 5 may be combined with a die guide such as the internal tooth die 10*c* for guiding the outer die 10*b* for rotation and axial movement.

According to the modification shown in FIG. 5, as described above, the guide for guiding the punch or the die is engaged by the members, i.e., the bolts 27, which angularly adjust the guide and prevent the angularly adjusted guide from being angularly shifted out of position. Therefore, the guide which has precisely been angularly adjusted is prevented from being angularly shifted out of position, and can easily be angularly adjusted.

An apparatus for manufacturing a pressed powder body according to a second embodiment of the present invention will be described below with reference to FIGS. 6 through 12. The apparatus according to the second embodiment is used to manufacture a pressed powder body in the shape of a gear blank W (see FIG. 11) from a fine metal powder. As shown in FIG. 11, the gear blank W has a central hole "c" defined centrally therein for insertion of a rotational shaft therein and a plurality of side holes "s" defined therein around the central hole "c". The side holes "s" serve to reduce the weight of the gear blank W.

Of these holes "c", "s", the central hole "c" in particular is required to have a strong peripheral edge. The apparatus according to the second embodiment has a means for increasing the mechanical strength of the peripheral edge of the central hole "c".

Figure 6:
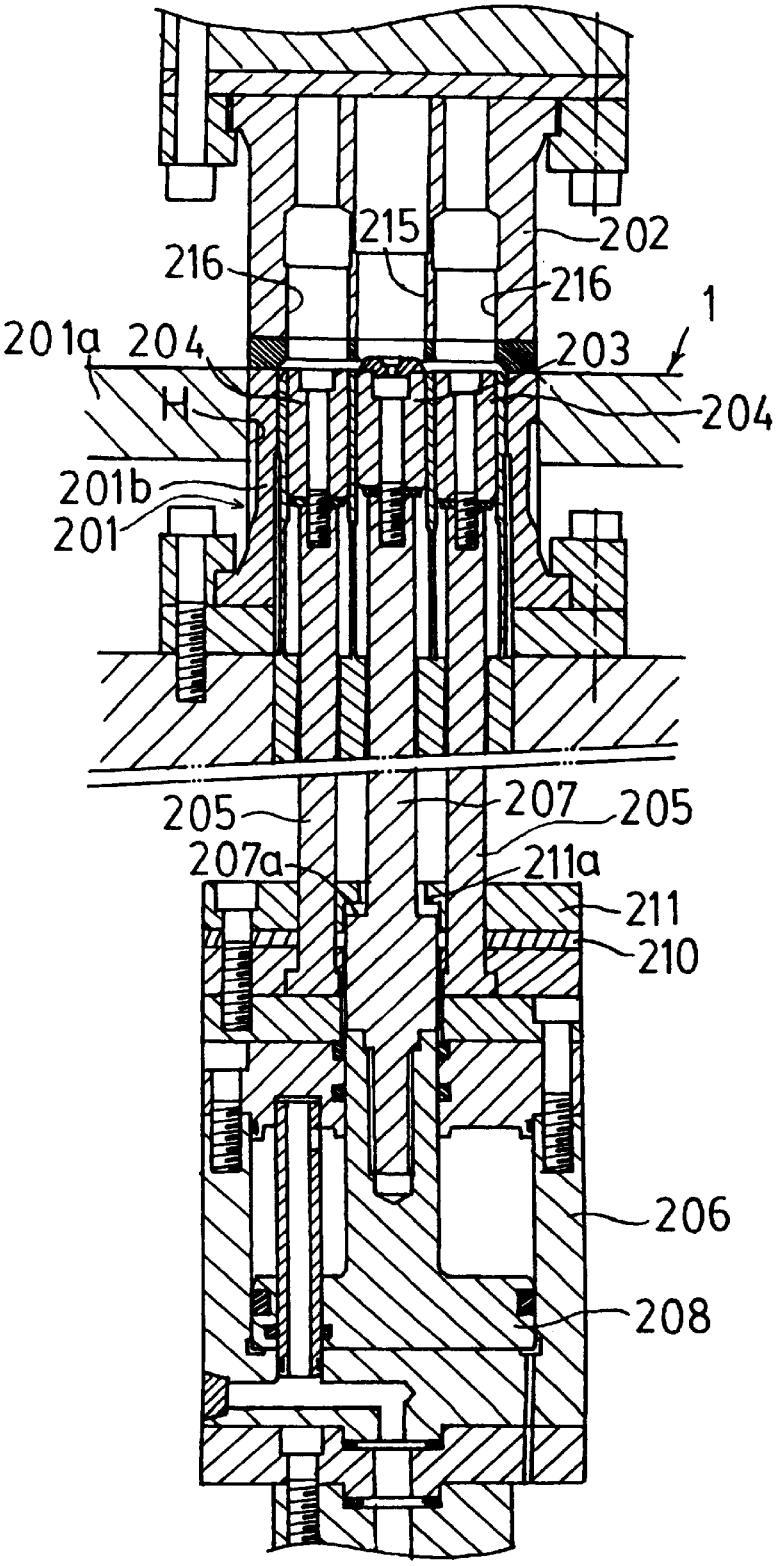
FIG. 6 is a fragmentary vertical cross-sectional view of an apparatus for manufacturing a pressed powder body according to a second embodiment of the present invention, the view showing the manner in which an upper punch is in a pressed state and a lower die is in a pushed state.

As shown in FIG. 6, the apparatus according to the second embodiment has a lower die 201 and an upper punch 202. The lower die 201 comprises a die 201*a* and a tubular lower punch 201*b*. The lower punch 201*b* is vertically movable in a vertical through hole H defined centrally in the die 201*a*. When the lower punch 201*b* is in a lower position, a space or die cavity P (see FIG. 7) is defined above the lower punch 201*b* within the through hole H. When lower punch 201*b* is in an upper position, there is no space or die cavity defined above the lower punch 201*b* within the through hole H (see FIG. 6).

The lower punch 201*b* houses a central core 203 and a plurality of side cores 204 vertically movably therein. The central core 203 serves to define the central hole "c" in the gear blank W, and the side cores 204 serve to define the side holes "s" in the gear blank W. The side cores 204 are joined to respective upper ends of vertical side core rods 205 which extend through the lower punch 201*b* and have respective lower ends connected to a lifter cylinder 206. The lifter cylinder 206 itself can be vertically moved by a hydraulic cylinder unit (not shown). When the lifter cylinder 206 is lifted, the side cores 204 are moved upwardly to project their upper end surfaces upwardly beyond an upper surface of the lower punch 201*b*.

The central core 203 is joined to an upper end of a central core rod 207 which extends through the lower punch 201*b* and has a lower end connected to a piston 208 of the lifter cylinder 206. The piston 208 is vertically movable in a cylinder bore defined in the lifter cylinder 206 by air introduced into the cylinder bore. A stop 211 is fixed through a spacer 210 to an upper end of the lifter cylinder 206 for limiting the vertical stroke of the piston 208. Specifically, the stop 211 has a flange 211*a* for engaging an upper end 207*a* of a large-diameter portion of the central core rod 207 to establish an upper limit position for the vertical movement of the central core 203.

Figure 7:
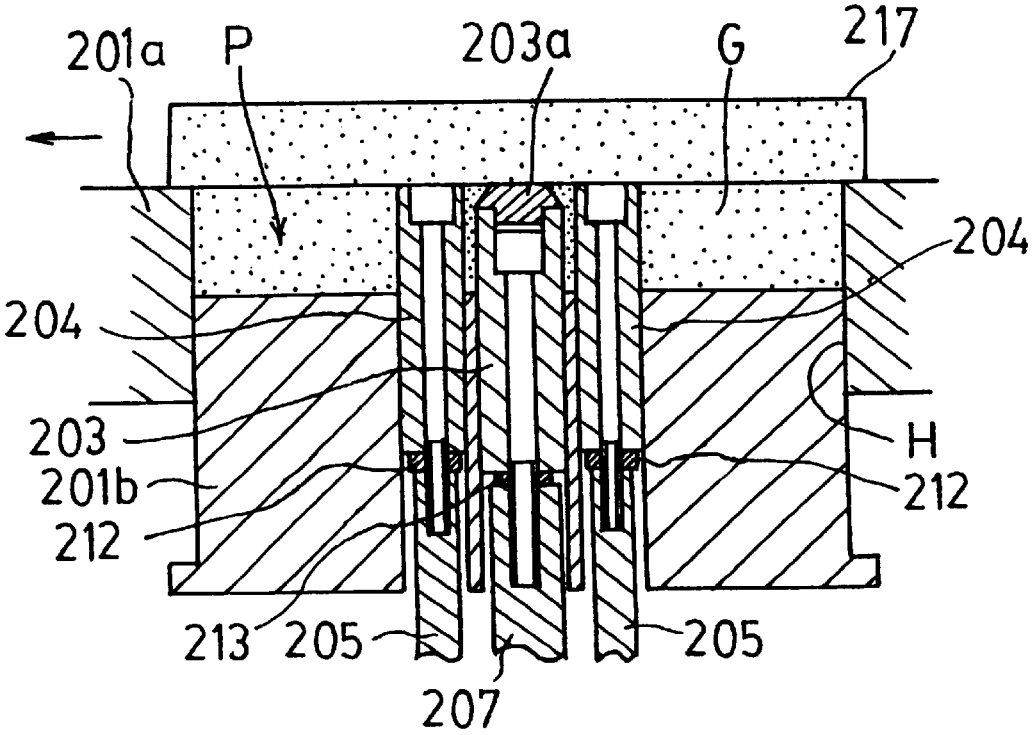
FIG. 7 is an enlarged fragmentary vertical cross-sectional view of the apparatus shown in FIG. 6, illustrating a powder pressing process with a material powder being filled.

As shown in FIG. 7, spacers 212 are interposed between the side cores 204 and the side core rods 205 for adjusting the distance by which the side cores 204 project upwardly. A spacer 213 is interposed between the central core 203 and the central core rod 207 for adjusting the distance by which the central core 203 projects upwardly.

Figure 12:
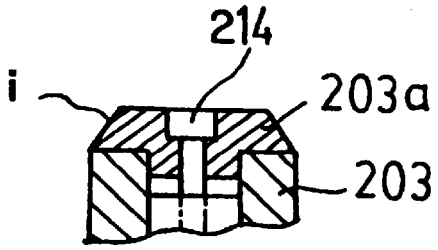
FIG. 12 is an enlarged fragmentary vertical cross-sectional view of an upper end of the central core.
Figure 13:
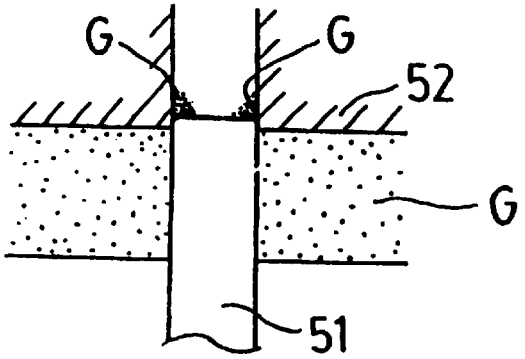
FIG. 13 (PRIOR ART)
FIG. 13 is an enlarged fragmentary vertical cross-sectional view showing a conventional process of manufacturing a pressed powder body.

As also shown in FIG. 12, a core tip 203*a* is removably fixed to the upper end of the central core 203 by a bolt 214. The core tip 203*a* is tapered off upwardly with a slanted outer peripheral surface "i" inclined downwardly in the outward direction. Actually, there are available a plurality of core tips 203*a* with respective slanted surfaces "i" inclined at different angles are available, and the core tip 203*a* mounted on the central core 203 is replaceable with a selected one of the available core tips 203*a*.

In FIG. 6, the upper punch 202 is vertically movable toward and away from the lower die 201. The upper punch 202 has a clearance hole 215 defined centrally therein and opening downwardly for insertion therein of the upper end of the central core 203. The upper punch 202 also has a plurality of clearance holes 216 defined centrally therein around the clearance hole 215 and opening downwardly for insertion therein of the respective upper ends of the side cores 204.

Operation of the apparatus according to the second embodiment for manufacturing a pressed powder body will be described below with reference to FIGS. 7 through 10.

As shown in FIG. 7, the lower punch 201*b* is lowered a given distance to define the die cavity P above the upper end of the lower punch 201*b* within the through hole H in the die 201*a*, and the central core 203 and the side cores 204 are elevated to hold their upper end surfaces lying flush with the upper surface of the die 201*a*, i.e., the upper end of the die cavity P. Then, a feeder box 217 containing a material powder G is horizontally slid on the upper surface of the die 201*a* to a position above the die cavity P. The material powder G contained in the feeder box 217 then drops into the die cavity P. After the die cavity P is filled with the material powder G, the feeder box 217 is horizontally retracted away from the die cavity P, leaving the material powder G filled as an unpressed body up to the upper end of the die cavity P.

Figure 8:
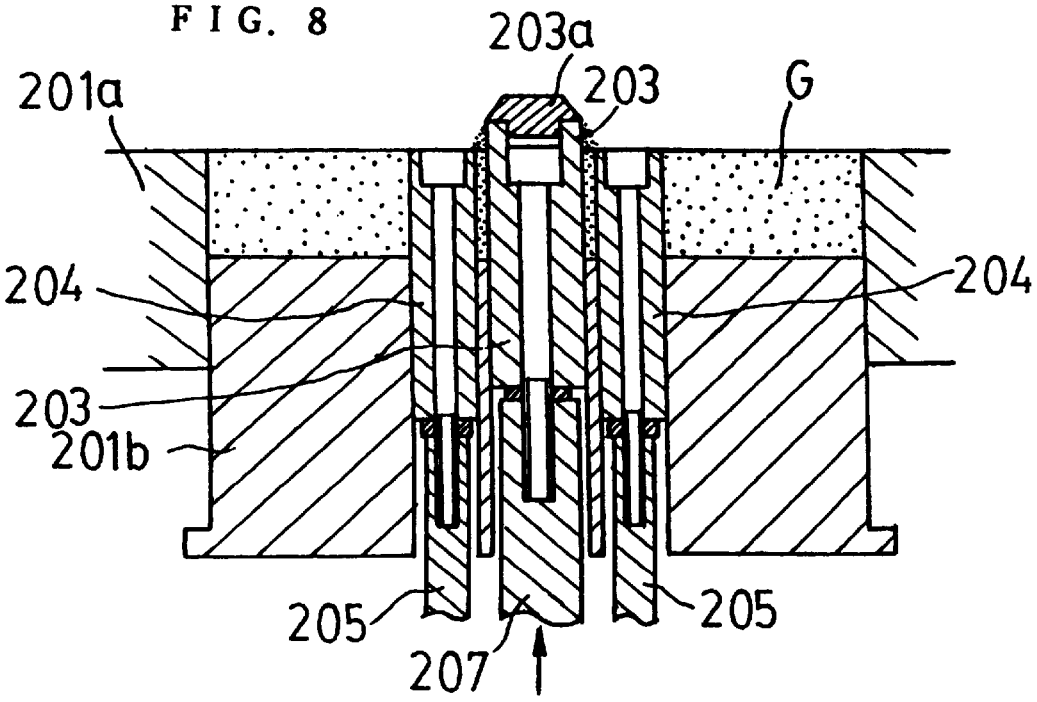
FIG. 8 is an enlarged fragmentary vertical cross-sectional view of the apparatus shown in FIG. 6, illustrating the powder pressing process with a central core being lifted.

Then, the piston 208 (see FIG. 6) is lifted to elevate the central core 203 as shown in FIG. 8. At this time, a portion of the material powder G which has been deposited on the slanted surface "i" of the core tip 203*a* slips down the slanted surface "i" off the core tip 203*a*, and is deposited on the upper surface of a layer of the material powder G which extends just around the central core 203. Stated otherwise, the slanted surface "i" does not scrape off and carry away any material powder G around the central core 203. The amount of the material powder G which is deposited just around the central core 203 progressively increases toward the central core 203 as shown in FIG. 8.

Figure 9:
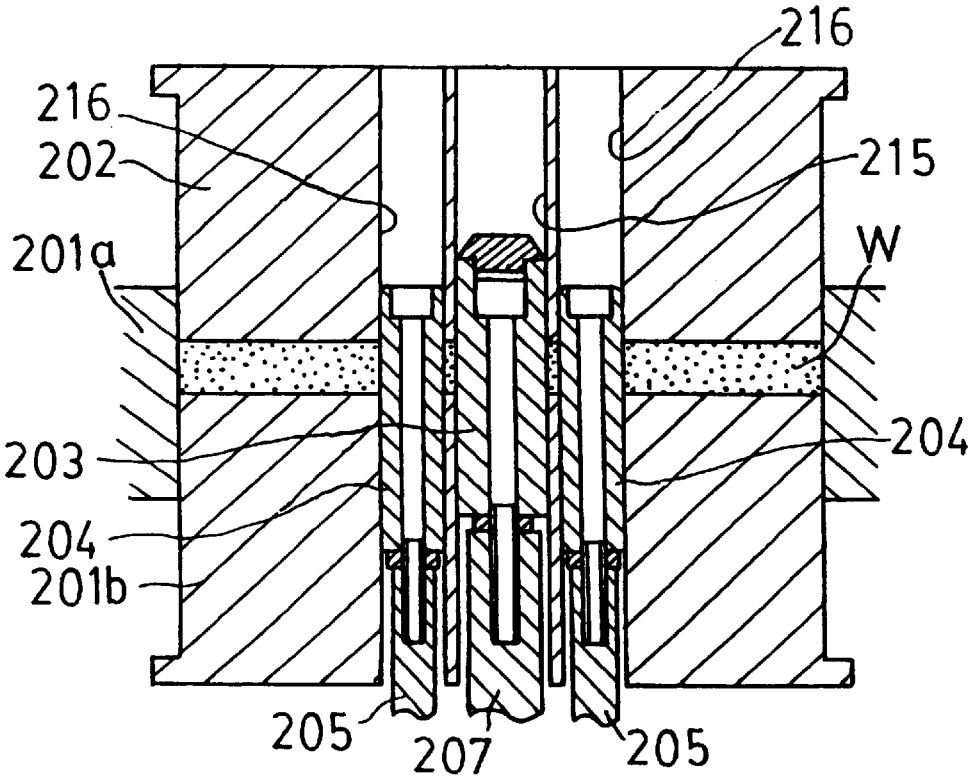
FIG. 9 is an enlarged fragmentary vertical cross-sectional view of the apparatus shown in FIG. 6, illustrating the powder pressing process with the material powder being pressed.

Thereafter, the upper punch 202 is lowered into the die cavity P as shown in FIG. 9. The upper end portions of the central and side cores 203, 204 are inserted respectively into the clearance holes 215, 216, and the material powder G filled in the die cavity P around the central and side cores 203, 204 within the die 201*a* is vertically pressed into a pressed powder body as a gear blank W between the lower punch 201*b* and the upper punch 202.

The pressed powder body thus formed has an inreased density of the material powder G just around the entral core 203.

Figure 10:
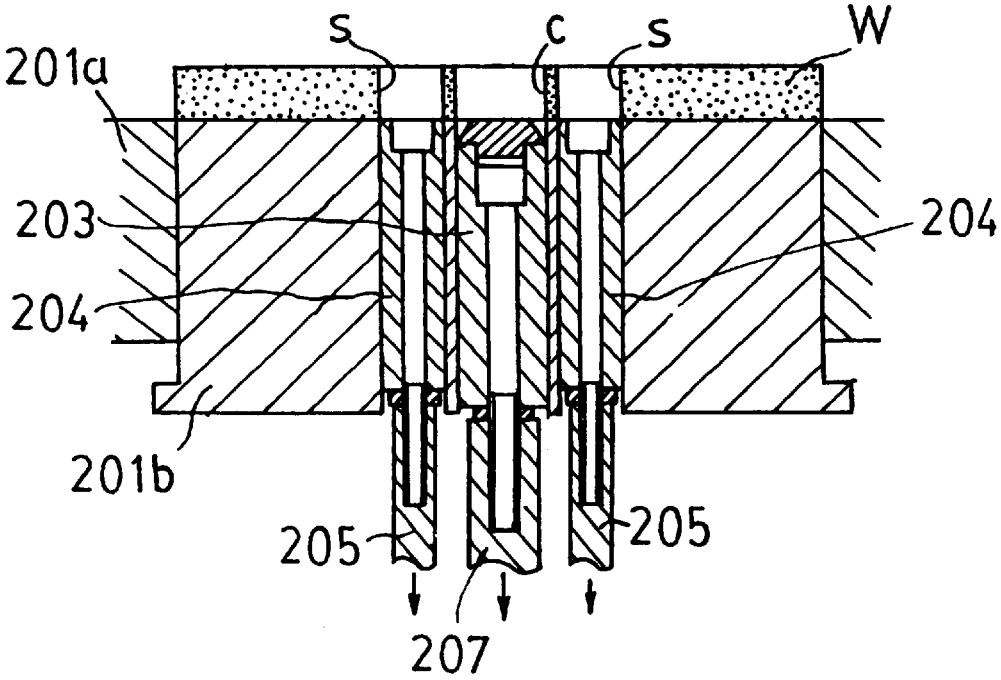
FIG. 10 is an enlarged fragmentary vertical cross-sectional view of the apparatus shown in FIG. 6, illustrating the powder pressing process with the pressed powder body being ejected.
Figure 11:
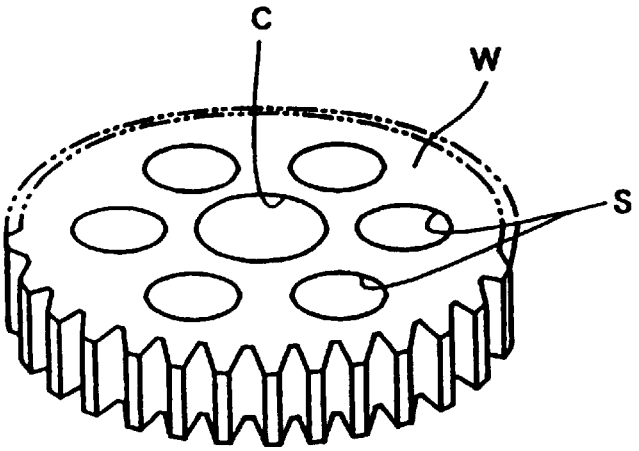
FIG. 11 is a perspective view of a gear blank as the pressed powder body.

Then, the piston 208 is lowered to lower the central core 203 a given distance as shown in FIG. 10. Thereafter, the lower punch 201*b* is elevated up to the upper surface of the die 201*a*, ejecting the gear blank W. The ejected gear blank W has an increased mechanical strength around the central hole "c" because of the increased density of the material powder G around the central hole "c".

The core tip 203*a* is selected whose slanted surface "i" is best suited to the type, particle size, and other properties of the material powder G used, so that any material powder G deposited on the slanted surface "i" can reliably slide off.

With the apparatus according to the second embodiment, as described above, the central core for defining the central hole in the gear blank is vertically movable in the die cavity, and the core tip on the upper end of the central core has the slanted peripheral surface which is inclined downwardly in the outward direction. Therefore, when the central core is lifted, the slanted surface does not scrape off and carry away any material powder around the central core. A portion of the material powder which has been deposited on the slanted surface drops off the core tip, and is deposited on a layer of the material powder around the central core. Consequently, the mechanical strength of the pressed powder body is prevented from being reduced, but rather is increased due to an increase in the density of the material powder around the central core.

The core tip on the central core can be replaced with a core tip having a slanted peripheral surface that is best suited-the type, particle size, and other properties of the material powder used.

Although certain preferred embodiments of the present invention have been shown and described in detail, it should be understood that various changes and modifications may be made therein without departing from the scope of the appended claims.

What is claimed is:

1. An apparatus for manufacturing a pressed powder body, comprising:

a die assembly comprising an upper die and a lower die, for pressing an unpressed powder body of a material powder into a pressed powder body between said upper die and said lower die, at least one of said upper die and said lower die being vertically movable to press said unpressed body; and powder increasing means for increasing an amount of the material powder locally in said unpressed powder body, said powder increasing means comprising at least one of said upper die and said lower die comprising an inner die member and an outer die member arranged in an axial alignment with each other and having pressing surfaces, the other of said upper die and said lower die having a flat pressing surface, said powder increasing means including means for moving the pressing surfaces of said one die toward and pressing the unpressed powder body at different times and means for causing the pressing surfaces of said one die to lie flush with each other at a final stage of pressing to form with said flat pressing surface substantially parallel extending flat surfaces on opposite sides of the pressed powder body, the pressed powder body partially having a greater density in a pressing region of a first of the pressing surfaces of said one of said upper die and said lower die relative to a second, said first of the pressing surfaces being last in pressing to achieve flush alignment.

2. An apparatus for manufacturing a pressed powder body, comprising:

a die assembly comprising an upper die and a lower die, for pressing an unpressed powder body of a material powder into a pressed powder body between said upper die and said lower die, at least one of said upper die and said lower die being vertically movable to press said unpressed body; and powder increasing means for increasing an amount of the material powder locally in said unpressed powder body;

said powder increasing means comprising at least one of said upper die and said lower die, said at least one of said upper die and said lower die comprising first and second die members, the other of said upper die and said lower die having a flat pressing surface, said powder increasing means including means for pressing with said first die member a first portion of said unpressed powder body at a first time and for pressing with said second die member a second portion of said unpressed powder body at a second time which is different from said first time, said first die member and said second die member having pressing surfaces, said powder increasing means further including means for causing the pressing surfaces of said first and second die members to lie flush with each other at a final stage of pressing to form with said flat pressing surface of the other of said upper die and said lower die substantially parallel extending flat surfaces on opposite sides of the pressed powder body which partially has a greater density in a pressing region of a first of the pressing surfaces of said first and second die members relative to a second, said first of the pressing surfaces being last in pressing to achieve flush alignment.

3. An apparatus for manufacturing a pressed powder body, comprising:

a die assembly comprising an upper die and a lower die, for pressing an unpressed powder body of a material powder into a pressed powder body between said upper die and said lower die, at least one of said upper die and said lower die being vertically movable to press said unpressed body; and powder increasing means for increasing an amount of the material powder locally in said unpressed powder body;

said powder increasing means comprising at least one of said upper die and said lower die, said at least one of said upper die and said lower die comprising first and second die members, said powder increasing means further including means for pressing a first portion of said unpressed powder body with said first die member at a first time and for pressing a second portion of said unpressed powder body with said second die member at a second time which is different from said first time, the other of said upper die and said lower die having a flat pressing surface, wherein after said first die member starts pressing said first portion of said unpressed powder body, said second die member starts pressing said second portion of said unpressed powder body, whereby the amount of the material powder in said second portion of said unpressed powder body which is pressed by said second die member is greater than the amount of the material powder in said first portion before said first die member starts pressing said first portion of said unpressed powder body, to provide a greater density in a portion of the pressed powder body corresponding to said second portion of said unpressed powder body;

said first die member and said second die member having pressing surfaces, said powder increasing means also including means for causing the pressing surfaces to lie flush with each other at a final stage of pressing to form with said flat pressing surface of the other of said upper die and said lower die substantially parallel extending flat surfaces on opposite sides of the pressed powder body.

4. An apparatus according to claim 2, wherein said first die member comprises an inner die for pressing an inner portion of said unpressed powder body as said first portion, and said second die member comprises an outer die for pressing an outer peripheral portion of said unpressed powder body as said second portion.

5. An apparatus according to claim 2, wherein said upper die comprises a punch and said lower die comprises a die, said punch comprising an inner punch as said first die member for pressing an inner portion of said unpressed powder body as said first portion against said die, and an outer punch as said second die member for pressing an outer peripheral portion of said unpressed powder body as said second portion against said die.

6. An apparatus according to claim 2, wherein said upper die comprises a punch and said lower die comprises a die, said die comprising an inner die as said first die member for pressing an inner portion of said unpressed powder body as said first portion against said punch, and an outer die as said second die member for pressing an outer peripheral portion of said unpressed powder body as said second portion against said punch.

7. An apparatus for manufacturing a pressed powder body, comprising:

a die assembly comprising an upper die and a lower die, for pressing an unpressed powder body of a material powder into a pressed powder body between said upper die and said lower die;

powder increasing means for increasing an amount of the material powder locally in said unpressed powder body, said powder increasing means comprising at least one of said upper die and said lower die, said upper die comprising first and second die members, said powder increasing means including means for pressing a first portion of said unpressed powder body with said first die member at a first time and for pressing a second portion of said unpressed powder body with said second die member at a second time which is different from said first time, wherein after said first die member starts pressing said first portion of said unpressed powder body in said die cavity, said second die member starts pressing said second portion of said unpressed powder body, said lower die comprising a third die member and a fourth die member for coaction with said first die member and said second die member, respectively, said third die member and said fourth die member jointly defining a die cavity in said lower die for filling said material powder therein;

a fixed member such that said fourth die member is fixedly mounted on said fixed member;

floating means disposed between said third die member and said fixed member, for floatingly supporting said third die member, said third die member, in a first position, projecting upwardly beyond said fourth die member such that said third die member and said fourth die member have respective pressing surfaces lying in different vertical positions in normal inoperative first position therefore; and lowering means for exerting a lowering force to said upper die to move toward said lower die, said third die member being lowerable to a second position under said lowering force exerted to said upper die by said lowering means against a pressure applied by said floating means to level the pressing surfaces of said third die member and said fourth die member in a final stage of pressing said unpressed powder body into said pressed powder body.

8. An apparatus according to claim 2, wherein said upper die comprises an inner punch as said first die member and an outer punch as said second die member which is rotatable around said inner punch and movable axially with respect to said inner punch; further comprising:

lowering means for exerting a lowering force to said upper die to move toward said lower die, said outer punch being rotatably mounted on said lowering means; and pressing means interposed between said lowering means and said upper die, for applying a pressing force to said inner punch to project a pressing lower end surface of said inner punch downwardly beyond a pressing lower end surface of said outer punch, and allowing said pressing lower end surface of said inner punch to lie flush with said pressing lower end surface of said outer punch under the lowering force exerted to said upper die by said lowering means at least in a final stage of pressing said unpressed powder body into said pressed powder body.

9. An apparatus for manufacturing a pressed powder body as a gear blank having helical teeth on an outer circumferential surface thereof, comprising:

a die assembly comprising an upper die and a lower die, for pressing an unpressed powder body of a material powder into a pressed powder body between said upper die and said lower die, at least one of said upper die and said lower die being vertically movable to press said unpressed body;

powder increasing means for increasing an amount of the material powder locally in said unpressed powder body;

said upper die including a first rotatable member, said lower die including a second rotatable member, said first rotatable member and said second rotatable member being rotatable with respect to each other, at least said first rotatable member having helical teeth on an outer circumferential surface thereof, said second rotatable member having helical teeth on an inner circumferential surface thereof for meshing engagement with said helical teeth on the outer circumferential surface of said first rotatable member; and a phasing mechanism comprising:

a support member movable with said first rotatable member toward said second rotatable member and stoppable at a position after having moved with said first rotatable member toward said second rotatable member;

a guide member fastened to said support member and held in mesh with said helical teeth on the outer circumferential surface of said first rotatable member, for guiding said first rotatable member for rotation; and means for angularly adjusting said guide member with respect to said support member to phase said first rotatable member to said second rotatable member and preventing said guide member which has been angularly adjusted from being angularly displaced.

10. An apparatus for manufacturing a pressed powder body, comprising:

a die assembly comprising an upper die and a lower die, for pressing an unpressed powder body of a material powder into a pressed powder body between said upper die and said lower die, at least one of said upper die and said lower die being vertically movable to press said unpressed body; and powder increasing means for increasing an amount of the material powder locally in said unpressed powder body;

said lower die comprising a die which defines thereabove a die cavity for filling the material powder therein;

said powder increasing means comprising a core disposed vertically movably in said die cavity for defining a vertical hole in the pressed powder body, said material powder being filled in said die cavity with said core disposed in the die cavity;

said upper die comprising a punch for pressing said unpressed powder body, except said core, in said die cavity to produce said pressed powder body with the vertical hole defined therein;

said core having an upper end including a slanted peripheral surface inclined at a predetermined angle downwardly in an outward direction;

said powder increasing means further including means for moving said core through said lower die in said die cavity after the material powder is filled in said die cavity and before the unpressed powder body is pressed by said upper die and said lower die, said core being moved vertically through said unpressed powder body to allow a portion of the material powder deposited on said slanted peripheral surface to drop down said slanted peripheral surface off said upper end of the core for thereby increasing the amount of the material powder around said core.

11. An apparatus according to claim 10, wherein said core comprises a removable core tip.

12. An apparatus according to claim 10, wherein said die cavity is of a shape adapted to manufacture a gear blank, and said core defines a central hole in said gear blank.

* * * * *